United States Patent [19]

Barson

[11] 4,149,225

[45] Apr. 10, 1979

[54] FRAMES FOR LANTERNS HAVING A MANTLE

[75] Inventor: Leslie Barson, Victoria, Australia

[73] Assignee: Companion Pty. Limited, Victoria, Australia

[21] Appl. No.: 828,088

[22] Filed: Aug. 26, 1977

[30] Foreign Application Priority Data

Aug. 28, 1976 [GB] United Kingdom ..... 35882/76

[51] Int. Cl.[2] ..... F21L 19/00

[52] U.S. Cl. ..... 362/186; 362/160; 431/111

[58] Field of Search ..... 362/159, 160, 171, 186; 431/109, 110, 111, 113, 344

[56] References Cited

U.S. PATENT DOCUMENTS

| | | | |
|---|---|---|---|
| 1,849,136 | 3/1932 | Currie | 362/186 |
| 2,785,290 | 3/1957 | Terry | 362/159 |
| 3,140,740 | 7/1964 | Lagreid et al. | 431/110 |
| 3,941,554 | 3/1976 | Curtis | 431/109 |

*Primary Examiner*—Carroll B. Dority, Jr.
*Attorney, Agent, or Firm*—Schuyler, Birch, Swindler, McKie & Beckett

[57] ABSTRACT

A lantern frame comprising a base, a burner mounted on the base burning with an incandescent flame, a glass surrounding the burner protecting the flame, a grid surrounding the glass supported on said base operable to stabilise said glass, the base being interengageable with the grid and a locking member for releasable interconnection whereby the parts are rigidly held together in assembled condition.

3 Claims, 5 Drawing Figures

FRAMES FOR LANTERNS HAVING A MANTLE

This invention relates to a frame for a lantern using a mantle and particularly to fuel gas lanterns.

The mantle is mounted in any known manner. Several U.S. Patents are known to Applicant which disclose methods of mounting a mantle. For example, U.S. Pat. Nos. 3,328,981, 3,240,036, 3,221,523, 2,755,649, 3,354,674 and 2,745,272. Each of these specifications relate to apparently improved means for actually supporting the mantle within the existing framework of a lantern. These various methods would be equally applicable for use with the present invention.

One of the major problems with lanterns of any type either using a wick or a mantle is the sound construction of the lantern frame. This particularly applies to portable lanterns which are adapted for use in outdoor living such as camping and hiking. Thus it is necessary for the framework to be strong in construction and because of the nature of operation not easily tampered with by unauthorised persons such as children thus ensuring safety in use. On the other hand it is necessary that lanterns, particularly those fitted with mantles, be easily disassembled and assembled to enable the operator to insert or replace the mantle over the gas burner or to clean and replace jets leading to the burner. Also it is desirable that the lantern be easily assembled by the manufacturer thereby reducing costs.

According to the present invention there is provided a frame for a lantern including a base having a burner therein connectible to a fuel supply, a grid and glass mounted on the base, the grid serving to restrain said glass and a handle, said grid, base and handle being releasably interconnectible whereby the parts are rigidly held together in assembled condition.

A lantern frame comprising a base, a burner mounted on the base burning with an incandescent flame, a glass surrounding the burner protecting the flame, a grid surrounding the glass supported on said base operable to stabilise said glass, characterised in that the base is interengageable with the grid and a locking member for releasable interconnection whereby the parts are rigidly held together in assembled condition.

Conveniently the locking member can be adapted for use as a carrying handle for the lantern.

The locking member is connectible with the base member and then rotatable through part of a circle for locking engagement with the base. The grid includes looped feet interengageable with the base through slots and the loops interconnect with said locking member.

Conveniently a hood is provided which may be a snap fit over the open end of the grid opposite said base member.

The invention will be described in greater detail having reference to the accompanying drawings showing a mantle lantern.

Figure 4:
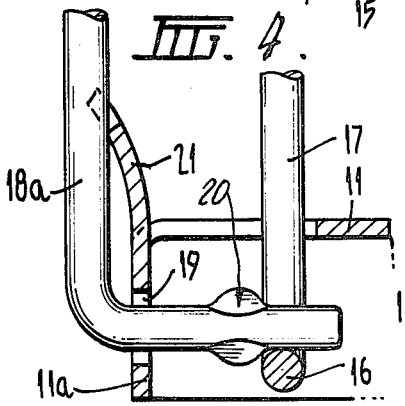
Figure 5:
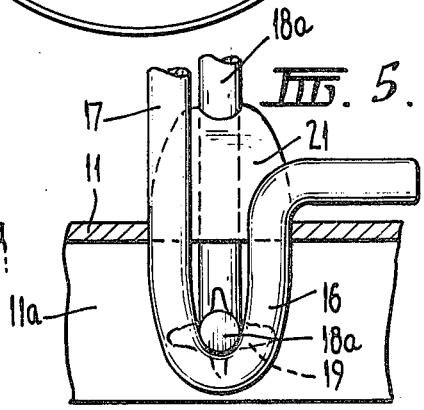

FIGS. 4 and 5 are enlarged partial sectional views of the locking arrangement of the invention taken on lines 4—4 and 5—5.

The invention will be described with reference to a portable gas lantern operating from a pressurised gas source such as liquid petroleum gas.

Figure 1:
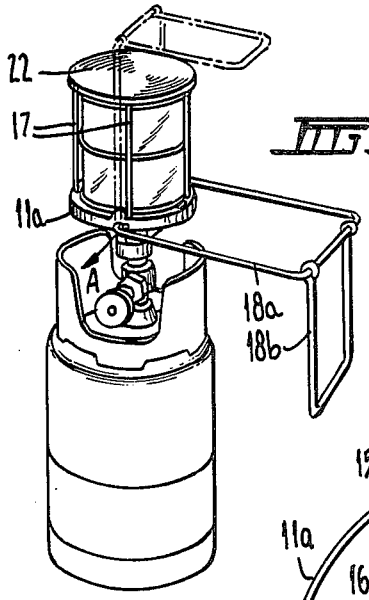
FIG. 1 is a view of the assembled lantern together with fuel receptacle.
Figure 2:
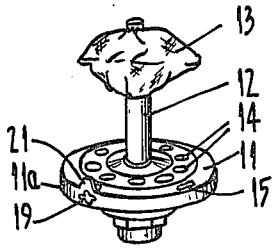
FIG. 2 shows the burner with mantle fitted.
Figure 3:
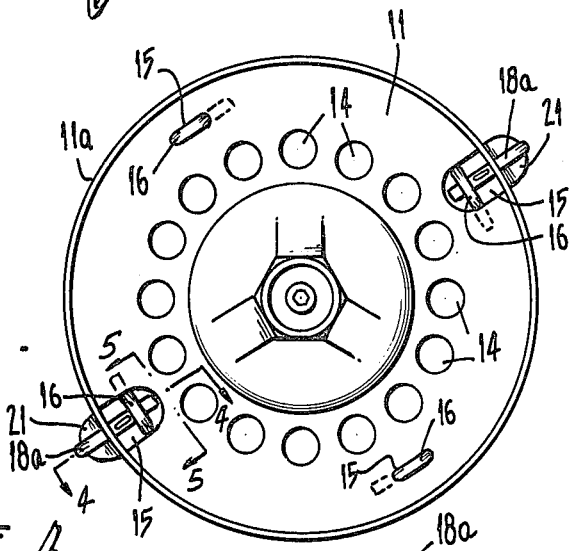
FIG. 3 is an underneath view of the lantern base before fitting to the fuel receptacle.

Referring to FIGS. 1 to 3, the base 11 includes a burner assembly 12 centrally mounted above the base with a mantle 13 being securable around the burner in known manner. The base includes a peripheral flange 11*a*. The base 11 includes apertures 14 to ensure adequate burning of the gas in the burner. The base 11 includes further apertures 15 near its outer periphery to receive looped portions 16 on the grid 17 therein. The burner 12 includes a tubular part with an opening at its top surrounded by the mantle 13 which is adapted to incandesce upon ignition of the gas in known manner.

FIGS. 4 and 5 show two elevational views of the base 11, grid member 17 and handle 18. The handle 18 is of two part U configuration having a locking part 18*a* and handle part 18*b*. The locking part 18*a* is pivotally located in side apertures 19 in the base flange 11*a*. The locking part 18*a* is of resilient material such as thick wire so that it can be spread outwardly in the direction of arrow A to engage and disengage in the side aperture 19.

Thus the transverse end portions of the locking part 18*a* enter the side apertures and interengage with the grid looped portions 16 previously inserted in the opposite peripheral apertures or slots 15 adjacent the side apertures 19.

Small lugs 20 are formed on the transverse portions of the locking part 18*a* which match the configuration of the side apertures 19 in the base flange 11*a* so that insertion of the transverse portions into the aperture can only take place with the handle directed to the side of the lantern as shown in FIG. 1. Thus movement of the handle to the normal vertical position as shown in phantom outline in FIG. 1 ensures that the parts are securely locked together and may only be dismantled by returning the handle to the horizontal position and spreading the legs outwardly in the direction of arrow A to disengage from the grid loops and the side apertures of the base. A lug 21 is provided on the base 11 near the apertures 19 to lock with the locking member 18*a*.

Thus assembly of the components during manufacture is simplified, and disassembly by the end user to replace a mantle or clean the fuel jets can be carried out with the minimum of instruction and inconvenience.

Thus as best seen in FIGS. 4 and 5, the grid 17, locking part 18*a* and base member 11 are securely interlocked to ensure rigid interconnection of the lantern parts. A metal lid 22 is easily snap fitted onto the top of the grid 17 as shown in FIG. 1.

I claim:

1. A frame for a lantern including a base having a burner therein connectible to a fuel supply, a grid and glass mounted on the base, the grid serving to restrain said glass, a handle, and interconnecting means for releasably interconnecting said grid, base and handle to hold said grid, base and handle together in assembled condition.

2. A lantern frame comprising a base, a burner mounted on the base burning with an incandescent flame, a glass surrounding the burner protecting the flame, a grid surrounding the glass supported on said base operable to stabilise said glass, characterised in that the base is interengageable with the grid and a locking member for releasable interconnection whereby the parts are rigidly held together in assembled condition.

3. A frame according to claim 2 wherein the locking member forms part of a handle to carry the lantern.

* * * * *